US006513895B2

(12) United States Patent
Bauer et al.

(10) Patent No.: US 6,513,895 B2
(45) Date of Patent: Feb. 4, 2003

(54) INCREASED STARTUP PULSE WARMING TEMPERATURE TO IMPROVE PEN STARTUP RELIABILITY

(75) Inventors: Stephen W. Bauer, San Diego, CA (US); Jeffrey D. Rutland, San Diego, CA (US); Grant Allen Webster, Valley Center, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/867,661

(22) Filed: May 30, 2001

(65) Prior Publication Data

US 2002/0180817 A1 Dec. 5, 2002

(51) Int. Cl.[7] ..... B41J 29/38
(52) U.S. Cl. ..... 347/14; 347/17
(58) Field of Search ..... 347/9–11, 14, 347/17, 19, 56, 60, 237, 351

(56) References Cited

U.S. PATENT DOCUMENTS 5,428,376 A * 6/1995 Wade et al. ..... 347/14
6,276,777 B1 * 8/2001 Schiaffino et al. ..... 347/17
6,293,641 B1 * 9/2001 Yoshimura et al. ..... 347/14

* cited by examiner

*Primary Examiner*—Raquel Yvette Gordon
*Assistant Examiner*—An H. Do

(57) ABSTRACT

A thermal inkjet printer is provided. The printer has a sensor that detects the operating temperature of its printhead. If the temperature of the printhead is below the printhead's normal operating temperature when the printer is going to start to print an image or document, the operating temperature of the printhead is set at a temperature higher than its normal temperature. This is to ensure that the drop-volume of the printer stays at an optimum level when the printer is beginning to start to print the image or document after a period of non-use. Shortly after the printer has started the printing task, the operating temperature of the printhead is reduced to its normal operating temperature.

20 Claims, 6 Drawing Sheets

INCREASED STARTUP PULSE WARMING TEMPERATURE TO IMPROVE PEN STARTUP RELIABILITY

FIELD OF THE INVENTION

The invention relates generally to a thermal inkjet printer; and more generally, to an optimum initial operating temperature for a thermal inkjet printer.

BACKGROUND OF THE INVENTION

In designing a thermal inkjet printer, it is important to provide as economically and simply as possible a relatively high output quality at a relatively high speed. The output quality and relative speed of a thermal inkjet printer are often times a function of the startup operating temperature of the printhead, especially after a period of non-use.

For example, conventional thermal inkjet printers contain multiple inkjet nozzles. Associated with each nozzle is a heating resistor and a drive transistor. The nozzle includes a nozzle chamber within which the heating resistor is located. To fire ink from the nozzle chamber, the drive transistor outputs a firing pulse to the heating resistor. The firing pulse is a current pulse of a magnitude sufficient enough to heat up the resistor and thus the ink to an ejection temperature. The ink then ejects from the chamber toward a print media sheet. To determine when any given nozzle is to fire, a controller circuit is used.

Typically, existing printers use a single print head operating temperature throughout the duration of printing a document. If this temperature is set too high, then a variety of longer term reliability issues can occur such as ink plugs in the nozzles, material degradation in the print head, or ejection of overly concentrated colorant from evaporation of the ink vehicle thought the nozzles. If this temperature is set too low, then there can be significant initial short term reliability issues with getting the print head to reliably fire when first called upon to do so. What is needed is high initial ejection reliability of high initial operating temperatures combined with the improved long term reliability afforded by lower operating temperatures for the duration of image.

In certain printers, to maximize reliable ink drop ejections, the ink is pre-heated. However, to pre-heat the ink when the printer is not is use would result in a waste of energy and ink as the ink will thicken or be reduced through evaporation. Furthermore, because of ink evaporation, pre-heating the ink during a long period of non-use may damage the printhead. For all these obvious reasons, therefore, the resistors are not pre-heated if the printer is not in use.

It is well known in the industry that one of the problems associated with thermal inkjet printers concerns the amount of ink ejected or deposited from the printhead during the formation of each ink drop. The quantity of deposited ink, commonly referred to as the "drop-volume" of the printhead, is dependent on the temperature of the printhead. If the printhead is cool, it will deposit less ink in each droplet. Missing, weak or low drop-volume results in poor quality images that appear faint or washed out. Consequently, when a printer has gone through a period of non-use or the printhead is cool, a certain amount of firing time is required to allow the printhead to reach its optimum drop-volume. This is usually accomplished by having the nozzles spit or eject low drop-volume ink droplets into a spittoon. Obviously, this scheme fosters ink wastage and a longer printing time.

Therefore, what is needed is a method to facilitate a thermal inkjet printer to reach its optimum drop-volume from a period of non-use as quickly as possible while minimizing ink wastage.

SUMMARY OF THE INVENTION

To overcome the limitations in the prior art described above, and to overcome other limitations that will become apparent upon reading and understanding the present specification, the present invention is embodied in a printing system for improving the edge sharpness, color uniformity, banding and faint or washed out appearance of ink drops produced by an inkjet printer.

The need in the art is addressed by the present invention. The present invention provides a thermal inkjet printer with the requisite technology to increase or reduce its operating temperature. The printer uses a sensor to detect the operating temperature of its printhead. If the temperature of the printhead is below the printhead's default or normal operating temperature when the printer is going to start to print an image or document, the operating temperature of the printhead is set at a temperature higher than its default or normal temperature.

This is to ensure that the drop-volume of the printer stays at an optimum level when the printer is starting to print the image or document after a period of non-use. Shortly after the printer has started the printing task, the operating temperature of the printhead is reduced to its default normal operating temperature. The higher temperature depends on the probability of successful ejection of the nth drop. Satisfactory image quality depends on all drops to have the proper volume, velocity and directionality.

The present invention as well as a more complete understanding thereof will be made apparent from a study of the following detailed description of the invention in connection with the accompanying drawings and appended claims.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. Other embodiments may be utilized and structural changes may be made without departing from the scope of the present invention.

I. General Overview

The present invention ensures reliable ejection of an optimum ink drop-volume as quickly as possible after a period of printer non-use. This is done by momentarily setting the temperature of the printhead at a temperature much higher than its standard operating temperature. After a certain period of time, the operating temperature of the printhead is reduced to its default or normal or standard operating temperature. In the present invention, the default or normal operating temperature of the printhead is 55 degrees Celsius and the higher temperature is 75 degrees Celsius.

II. Detailed Operation of the Invention

Figure 1:
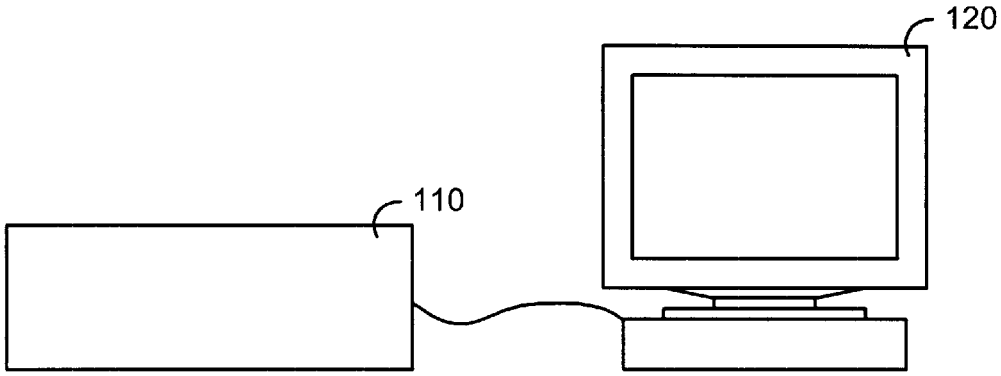
FIG. 1 depicts a block diagram of an inkjet printer connected to a workstation.
Figure 2:
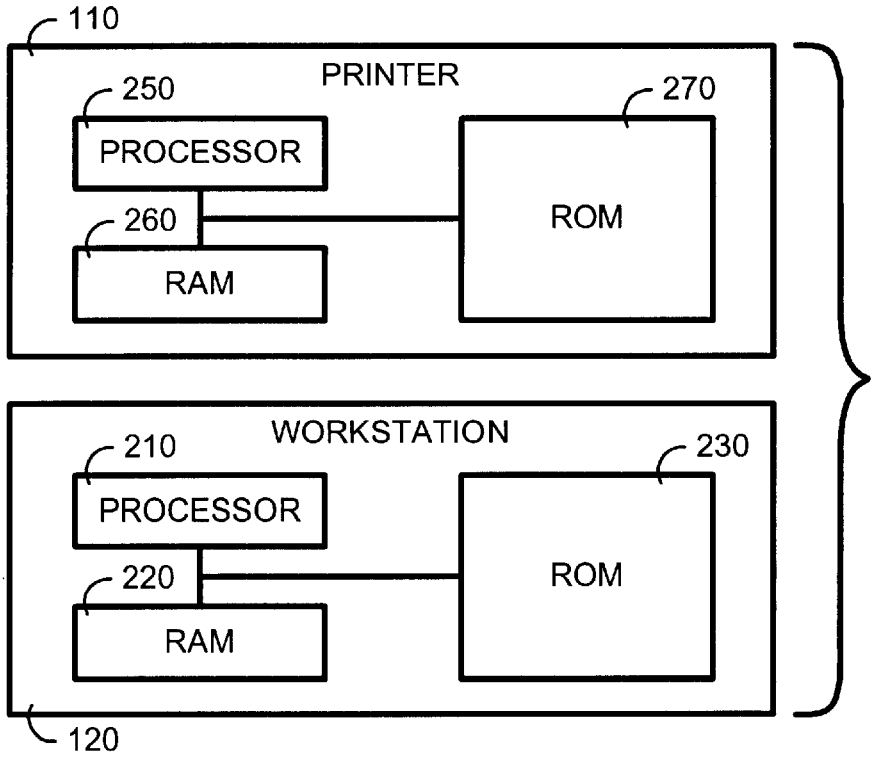
FIG. 2 illustrates particular aspects of the printer and the workstation.

With reference now to the figures, FIG. 1 depicts a block diagram of an inkjet printer 110 connected to a workstation 120. This invention may also be implemented in other types of printers, such as bubble jet printers. Further, although the invention is described in the context of printers, it may also be used in conjunction with other image reproduction systems such as copiers, scanners and the like.

As is well known in the field, the workstation 120 has at least one processor 210 to process data, including printing data. The workstation 120 also has a system memory 220 (e.g., RAM) that holds data that is to be immediately used by the processor 210 and a storage system 230 (e.g., ROM, hard disk, floppy disk, CD-ROM etc.) to store application programs. One such application program is a printer driver that is used to control the printer 110.

The printer 110 itself has a processor 250, a volatile memory 260 (e.g., RAM) and a non-volatile memory 270 (e.g., ROM, flash etc.). The processor 250 is used to control all moving mechanical parts of the printers as well as to heat up and to fire the nozzles. Just as in the case of the workstation 120, the volatile memory 260 is used to hold data for the immediate use of the processor 250. The non-volatile memory 270 is used to store, among other programs, the present invention.

Figure 3:
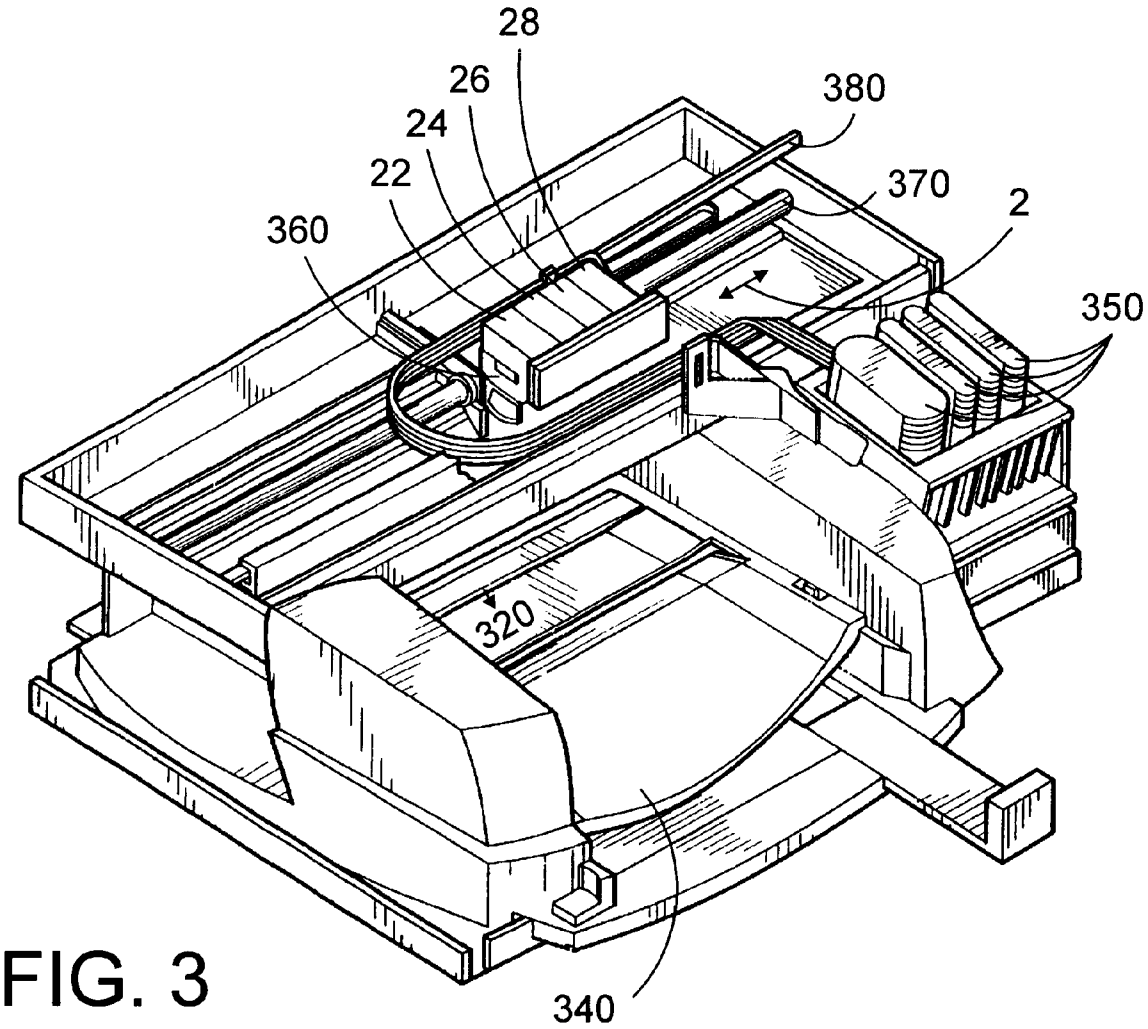
FIG. 3 is a perspective view of the inkjet printer.

However, before delving into the present invention, a brief description of an inkjet printer is needed. FIG. 3 is a perspective view of the inkjet printer 110. The printer 110 has an input tray 310 containing sheets of print medium which pass through a printing zone and along a print medium advance direction 320, past an exit 330 into an output tray 340. Electronics control 350 for commanding the processor 250 to perform various functions are included.

A movable carriage 360 holds print cartridges 22, 24, 26 and 28 which respectively hold yellow (Y), magenta (M), cyan (C) and black (B) inks and dispense these inks upon command from the processor 250. The back of the carriage 360 has multiple bushings (not shown) which ride along a slide rod 370, enabling bidirectional movement of the carriage along the rod 370.

The carriage 360 thus moves along a carriage scanning direction 2, above a sheet of print medium upon which an image is being formed by print cartridges 22–28. The position of the carriage 360, as it traverses the print medium back and forth, is determined by an encoder strip 380. This very accurate positioning device enables selective firing of the various ink nozzles on each print cartridge at the appropriate times during each carriage scan to form the image.

With each scan or swath pass of the carriage 360, the print medium is advanced incrementally in the direction 320 along the print medium axis. These incremental advances allow for an image or document to be printed on a media sheet.

Figure 4:
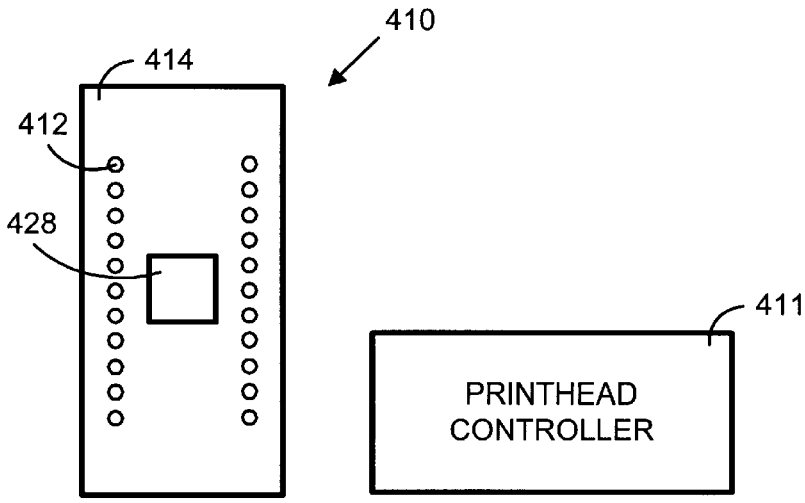
FIG. 4 depicts a thermal inkjet printhead and a printhead controller.

FIG. 4 depicts a thermal inkjet printhead 410 and a printhead controller 411. The printhead 410 includes a plurality of nozzles 412 and is part of an inkjet pen (not shown) used for printing ink onto a media sheet. Note that although two columns of nozzles, many more can be used and would be well within the scope of the present invention. Along with the nozzles, a temperature sensor 428 is shown. The temperature sensor is used to measure the temperature of the printhead 410. The printhead controller 411 is connected to printhead 410 and monitors the temperature sensor 428.

Figure 5:
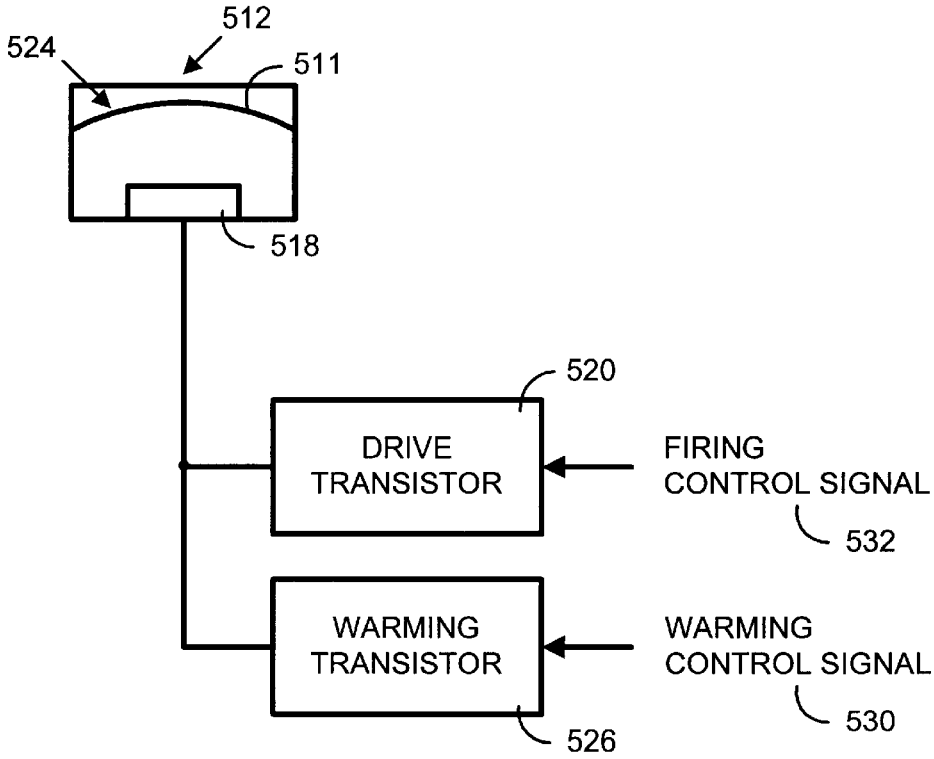
FIG. 5 illustrates one of a plurality of nozzles used in the present invention.

FIG. 5 illustrates one of a plurality of nozzles used in the present invention. As shown in FIG. 5, each nozzle includes a nozzle chamber 516 for holding ink 511 and a heating resistor 518. In operation, the heating resistor 518 receives a firing pulse from drive transistor 520 causing the heating resistor 518 to heat up the ink 511 in the chamber 516 to ejection temperature in order to eject the ink through orifice 524. For each nozzle, there is a corresponding nozzle chamber 516, heating resistor 518, drive transistor 520 and heating transistor 526. Although two transistors are used (one to pre-heat and one to drive resistor 518), the use of one transistor is perfectly within the scope of the present invention. In that case, the one transistor can fire less pulse current to pre-heat resistor 518 and more pulse current to drive resistor 518.

Figure 6:
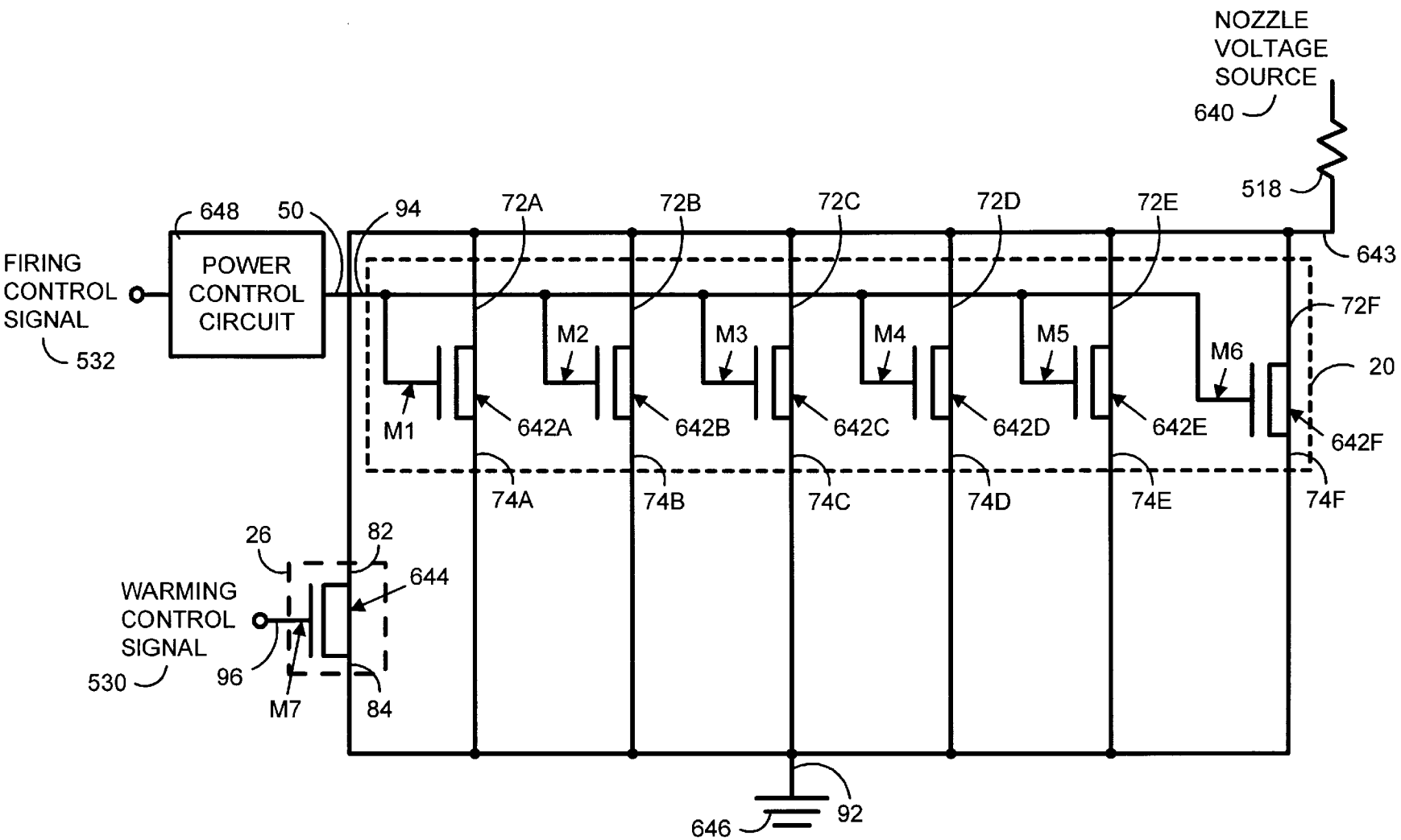
FIG. 6 is a schematic diagram of a nozzle circuitry associated of the present invention.

FIG. 6 is a schematic diagram of the nozzle circuitry associated with a given nozzle 412. The heating resistor 518 is coupled to a nozzle voltage source 640 at one contact point and to the drains of the drive transistor 520 and warming transistor 526 at another contact point. The drive transistor 520 is formed by one or more power field effect transistor (FET) devices 642. In the embodiment illustrated six FETs 642*a*–642*f* formed the drive transistor 520. The warming transistor 526 is formed by a smaller FET device 644.

The drains of the FET devices 642 and 644 are coupled in common to the heating resistor 518 via an interconnect 643. The sources of the devices 642 and 644 are coupled in common to ground 646. The gates M1–M6 of the FET devices 642*a*–642*f* are coupled to a power control circuit 648 which receives the firing control signal 532. The gate M7 of the warming transistor device 644 is coupled to the printhead controller 411 for receiving the warming control signal 530.

Figure 7:
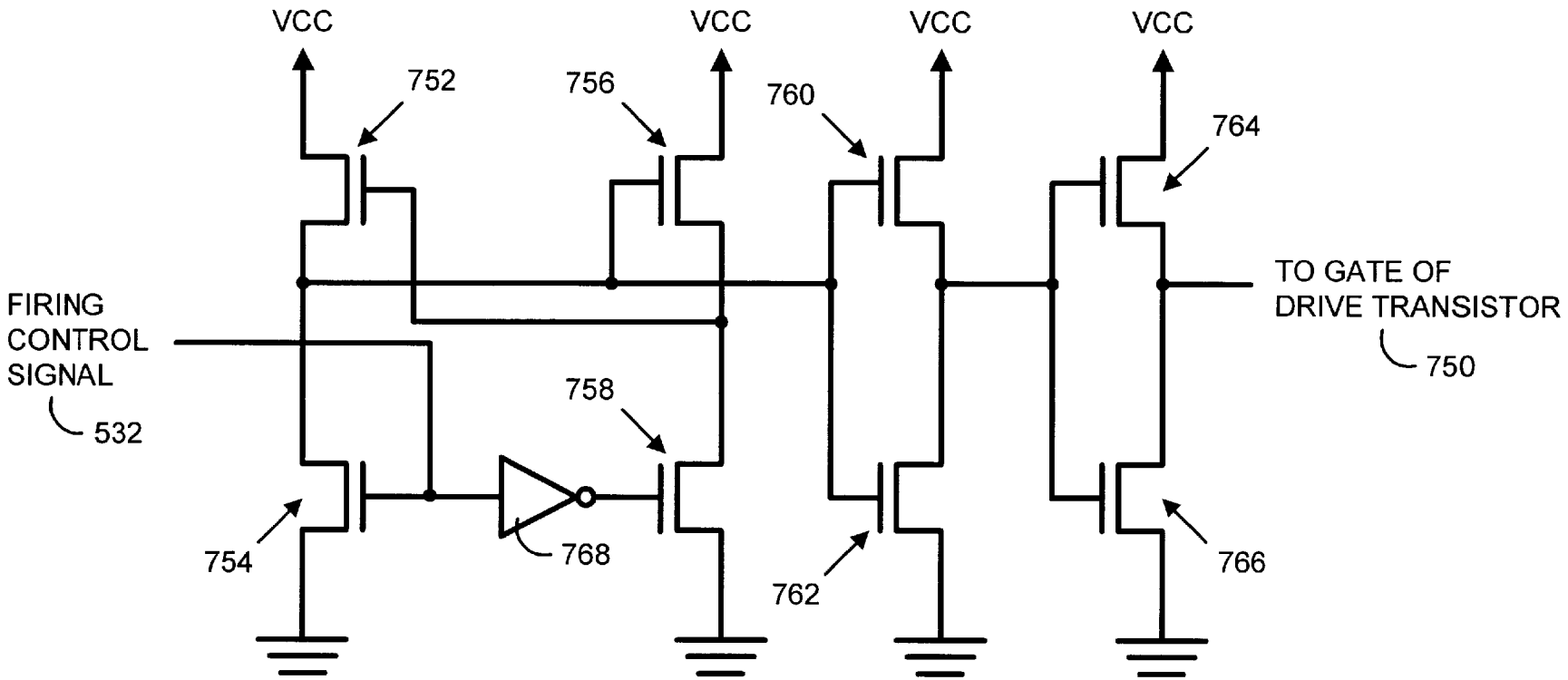
FIG. 7 is a schematic diagram of the power control circuit 648.

FIG. 7 is a schematic diagram of the power control circuit 648. The power control circuit 648 is formed by a set of current booster circuits. A firing control signal is received from the printhead controller 411. The signal is boosted to generate a signal 750 input to the gates M1–M6 of the drive transistor devices 642. In the illustrated embodiment, the power control circuit includes eight FET devices 752–766 and an inverter 768.

The firing control signal 532 is active when a logic low is received at the power control circuit 648. The logic low is inverted at inverter 768 resulting in a logic high signal 750 output from the power control circuit 648 into the gates M1–M6 of the drive transistor devices 642. Referring again to FIG. 6, the gates M1–M6 allow current flow through the devices 642. Specifically, current flows from the nozzle voltage source 640 through the heating resistor 518 into the drains 72*a*–74*f* to ground 46. When an inactive signal (e.g., a logic high) is received at power control circuit 648, signal 750 is a logic low. Thus, the junction from drain to source at drive transistor devices 642*a*–642*f* is closed.

When an active signal level is received at the warming transistor device 644, gate M7 enables current flow through the device 644. Specifically, current floes from the nozzle voltage source 640 through the heating resistor 518 into the drain 82 and out through the source 84 of the warming transistor 644 to ground 646. When an inactive signal level is received at the gate M7 of the warming transistor device 644, the junction from drain 82 to source 84 is closed.

The warming control signal 530 and the firing control signal 532 are separate signals having separate signal paths. To generate a warming pulse, the firing control signal 532 is inactive and the warming control signal is active. Thus, a small current flows from the nozzle voltage source 640 through the heating resistor 518 into the drain 82 and out the source 84 of the warming transistor 644 to ground 646. The current flowing through the heating resistor 518 is based upon the size of the transistor device 644. Such current is insufficient to cause the nozzle 412 to fire. Warming transistor device 644 is used as a switching device turning the current flow through the device 644 on or off. The current magnitude for a warming pulse may be between 2.0 and 3.5 mA; and the nozzle voltage around 21 volts.

To generate a firing pulse, the warming control signal 530 is inactive and the firing control signal is active. Thus, current flows from the nozzle voltage source 640 through the heating resistor 518 into the drains 72*a*–72*f* and out of the source 74*a*–74*f* to ground 646. The current flowing through the heating resistor 518 is based upon the number and size of the transistor devices 642*a*–642*f*. Such current is enough to cause a nozzle 412 to fire. The current magnitude for a firing pulse may be around 300 mA and the nozzle voltage source around 21 volts.

Obviously, other voltage and current levels may be used in alternative embodiments. Furthermore, to fire a nozzle 412 both a firing signal 532 and a warming signal 530 may be active so that current flows from the nozzle voltage source 640 through the heating resistor 518 and through all the devices 642 and device 644 to ground 646.

When both the firing control signal 532 and the warming control signal 530 are inactive, current does not flow through the devices 642 and 644. Consequently, current does not flow through the heating resistor 518.

Returning back to FIG. 4 and FIG. 5, when a given nozzle 412 is to be fired, the controller 411 sends a firing control signal 532 to drive transistor 520 for such nozzle 412. Further, as the controller 411 monitors temperature sensor 428, if it detects that the temperature of the printhead falls below a threshold temperature, the controller 411 generates a warming control signal 530 for one or more nozzles 412 to bring the printhead temperature back to the operating temperature. In the present invention, the printhead operating temperature is around 55 degrees Celsius.

When the printer is not in use, the printhead temperature will fall below the operating temperature of 55 degrees Celsius. It will continue to fall until it reaches ambient temperature, which often is room temperature (around 25 degrees Celsius). When a printhead starts at that temperature, it often requires a certain number of spits before optimum drop-volume can be reliably achieved. In an experiment, it was shown that if the printhead temperature is brought to the 55 degrees Celsius operating temperature from a period of non-use, at least 10 spits (this number depends on the printer) were needed before the optimum drop-volume was achieved. It was also shown that if the printhead temperature is brought to 75 degrees Celsius, zero spits was needed to obtain the optimum drop-volume. Thus, 75 degrees Celsius seems to be an ideal start-up temperature for the printhead.

However, having the printhead operate continually at that high of a temperature can foster reliability issues such as material incompatibility. Furthermore, the higher temperature may foster faster water evaporation (in the case of a water based ink) through the nozzles which ultimately may cause ink plugs. Thus, after the initial start-up temperature of 75 degrees Celsius, the temperature of the printhead should be reduced to the optimum 55 degrees Celsius operating temperature. In that experiment it was shown that if the temperature of the printhead was reduced to 55 degrees Celsius after 5 to 500 ink droplets (this number depends on the inkjet printer), no problems with reliability issues or ink plugs ensued.

In the present invention, therefore, the printhead controller 411 of FIG. 4 is designed to bring the initial temperature of the printhead 414 momentarily to 75 degrees Celsius and then to reduce the printhead operating temperature to 55 degrees Celsius. The 75 degrees Celsius temperature allows for a more efficient ink ejection (i.e., grams of ink per uJ of energy) . This efficient ink ejection eliminates ink plugs and chamber bubbles. Consequently, the time for nozzle recovery is significantly reduced.

Figure 8:
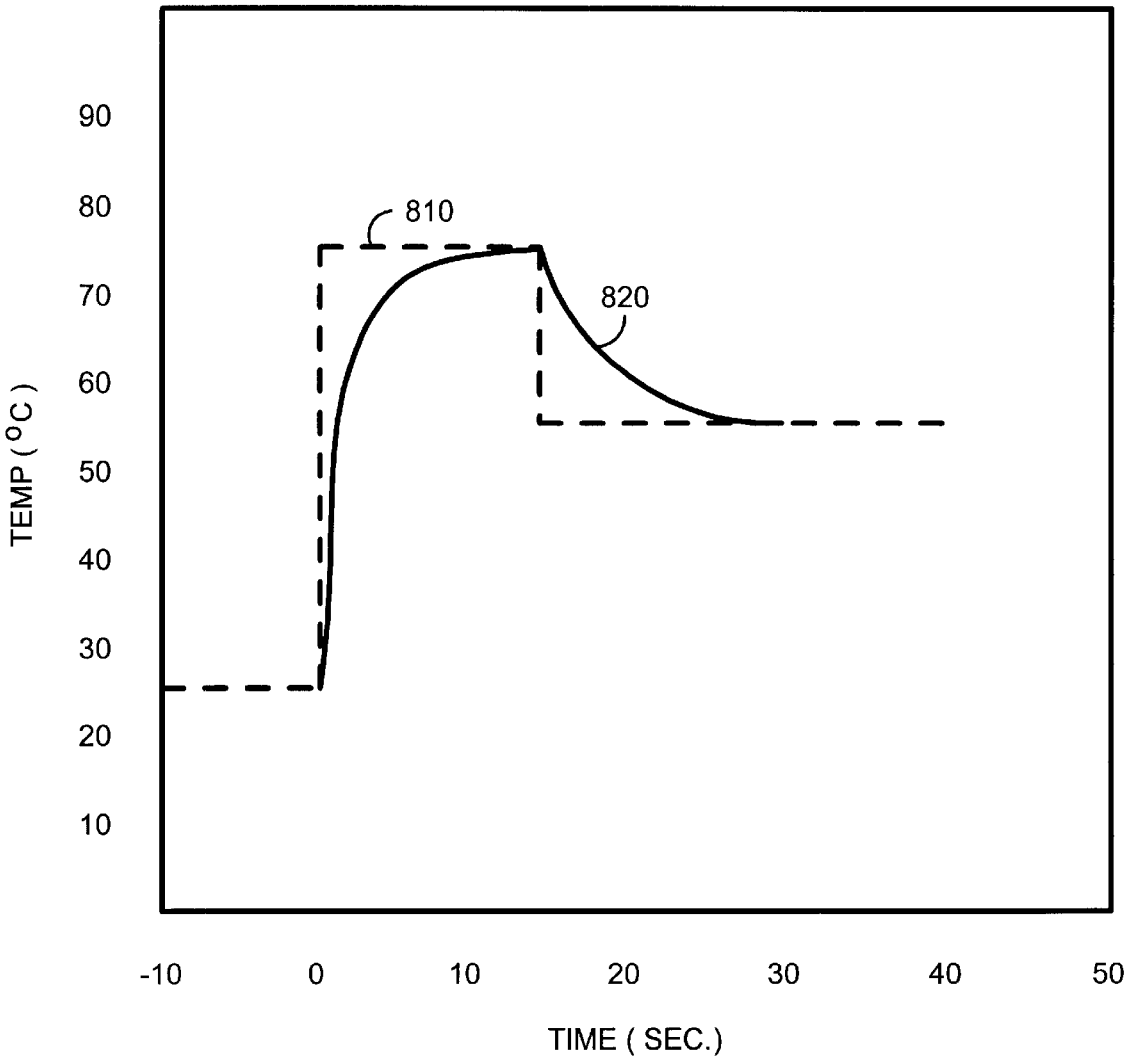
FIG. 8 illustrates a chart of temperature versus time of the present invention.

FIG. 8 illustrates a chart of temperature versus time of the present invention. Dashed line 810 is the control temperature line and solid line 820 is the actual printhead temperature line. Note that the control time for the higher temperature can vary anywhere from 10 msec to 1 sec. In this figure, the higher temperature is set at 75 degrees Celsius and the default or normal operating procedure is set at 55 degrees Celsius, but both temperatures can vary. This variation may be dependent upon a particular printer.

IV. Conclusion

The description of the present invention has been presented for purposes of illustration and description, but is not intended to be exhaustive or limited to the invention in the form disclosed. Many modifications and variations will be apparent to those of ordinary skill in the art. Therefore, the foregoing description should not be taken as limiting the scope of the invention defined by the appended claims.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of controlling operational functions of an inkjet printer with a printhead controller, the inkjet printer not having been in use immediately before a present printing task, the method comprising:

setting an initial operating temperature of the printhead at a temperature higher than a default operating temperature;

starting the present printing task;

instructing the inkjet printer to eject a number of spits of ink to be purged from the inkjet printer exclusively based on the initial operating temperature; and reducing the initial temperature to the default operating temperature.

2. The method of claim 1 wherein the higher temperature depends on the probability of successful ejection of the nth drop.

3. The method of claim 2 wherein after a set time the higher temperature is reduced to the normal temperature.

4. The method of claim 3 wherein the normal or higher temperature is the temperature of a printhead of the printer.

5. The method of claim 4 wherein the higher temperature is 75 degrees Celsius.

6. The method of claim 5 wherein the normal operating temperature is 55 degrees Celsius.

7. A method of controlling operational functions of an image reproduction system with a printhead and a printhead controller, the system not having been in use immediately before a present image reproduction task, the method using the printhead controller comprising:

setting an initial operating temperature of the system at a temperature higher than a normal operating temperature;

starting the image reproduction task;

ejecting a number of spits of ink to be purged from the printhead exclusively based on the initial operating temperature; and reducing the initial temperature to the normal operating temperature.

8. The method of claim 7 wherein the higher temperature depends on the probability of successful ejection of the nth drop.

9. The method of claim 8 wherein the higher temperature is reduced to the normal temperature after a set time.

10. The method of claim 8 wherein successful ejection involves satisfactory volume, velocity and direction of the ink ejection.

11. The method of claim 10 wherein the normal operating temperature is 55 degrees Celsius.

12. A thermal inkjet printer comprising:

an input tray for storing printing media sheets;

an output tray for storing printed media sheets; and a printhead for printing on the media sheets, the printhead including a printhead controller that sets the printhead to an operating temperature higher than a normal operating temperature when starting a printing task, and instructs the printhead to eject a number of spits of ink to be purged from the inkjet printer exclusively based on the initial operating temperature.

13. The printer of claim 12 wherein shortly after starting the printing task, the higher operating temperature is reduced to the normal operating temperature.

14. The printer of claim 13 wherein if the printer is continuously printing, the printhead is not set at that higher temperature when starting a printing task.

15. The printer of claim 14 wherein the higher temperature is set at 75 degrees Celsius.

16. The printer of claim 15 wherein the normal temperature is set at 55 degrees Celsius.

17. An image reproduction system comprising:

an input tray for storing printing media sheets;

an output tray for storing printed media sheets; and a printhead for printing on the media sheets, the printhead including a printhead controller that sets the printhead to an operating temperature higher than a normal operating temperature when starting a printing task, and instructs the printhead to eject a number of spits of ink to be purged from the printhead exclusively based on the initial operating temperature.

18. The system of claim 17 wherein shortly after starting the printing task, the higher operating temperature is reduced to the normal operating temperature.

19. The system of claim 18 wherein if the printer is continuously printing, the printhead is not set at that higher temperature when starting a printing task.

20. The system of claim 19 wherein the higher temperature is set at 75 degrees Celsius and the normal temperature is set at 55 degrees Celsius.

* * * * *